United States Patent [19]

Blanton

[11] 4,211,293

[45] Jul. 8, 1980

[54] VARIABLE ORIFICE SLEEVE VALVE HYDRAULIC JAR TOOL

[75] Inventor: James R. Blanton, Dallas, Tex.

[73] Assignee: Dresser Industries, Inc., Dallas, Tex.

[21] Appl. No.: 12,940

[22] Filed: Feb. 21, 1979

[51] Int. Cl.[2] ..... E21B 1/10

[52] U.S. Cl. ..... 175/297; 251/206

[58] Field of Search ..... 166/297, 296; 251/206

[56] References Cited

U.S. PATENT DOCUMENTS

| | | | |
|---|---|---|---|
| 3,087,559 | 4/1963 | Hazer et al. | 175/297 |
| 3,780,916 | 12/1973 | Shapland | 251/206 |
| 4,023,630 | 5/1977 | Perkins et al. | 175/297 |
| 4,148,460 | 4/1979 | Kinsler | 251/206 |

*Primary Examiner*—William F. Pate, III

*Attorney, Agent, or Firm*—Eddie E. Scott; Fred A. Winans

[57] ABSTRACT

A hydraulic jarring tool includes a system for externally adjusting the orifice size of the sleeve valve flow passage. The jarring tool includes an outer member and an inner member telescopically arranged. Spline means between said outer member and said inner member transmit torque. A hammer and anvil system provides a jarring effect upon actuation of the tool. An upper seal and lower seal provide a fluid seal between said outer member and said inner member. A working fluid is maintained in a working fluid chamber between the upper and lower seals. A detent means provides a tripping action to produce the jarring effect. The detent means includes an orifice plate that is rotatable to change the fluid restriction. An exterior port allows a wrench or tool to be inserted to rotate the orifice plate to provide selectable orifice passages that produce the detent action by the slow metering of hydraulic working fluid.

1 Claim, 4 Drawing Figures

VARIABLE ORIFICE SLEEVE VALVE HYDRAULIC JAR TOOL

TECHNICAL FIELD

The present invention relates in general to the art of earth boring and, more particularly, to a rotary hydraulic jarring tool.

BACKGROUND OF THE INVENTION

During the drilling of an oil or gas well or the like, situations are encountered wherein a component of the drill string becomes lodged in the borehole. It is, of course, necessary to dislodge this component of the drill string in order to continue the drilling operation. A rotary jarring tool is positioned in the drill string to allow the striking of blows to the drill string and the loosening of and dislodging of the stuck portion of the drill string. For example, rotary jarring tools are installed in fishing strings to enable the driller to strike heavy upward blows against an engaged fish to jar it loose from its stuck position. Rotary jarring tools are included in drill strings during testing, coring and washover operations to act as safeguards and to provide a system with which to loosen the drill string should it become stuck.

Rotary jarring tools include various types of restraining or detent mechanisms which hold the telescopic elements of the jarring tool in a closed position until sufficient upward pull is exerted to trip the restraining mechanism and allow the telescopic elements to rapidly move to their extended position. The force of the upward pull stretches the drill pipe. When the restraining or detent mechanism trips, the upward surge of the drill pipe in returning to its normal length will allow a severe blow to be imparted to the drill string by the jarring tool.

Hydraulic jarring tools utilize a hydraulic working fluid and valve system to provide the tripping action. The jarring tool includes a seal system having upper and lower seal assemblies with the working fluid located therebetween and a metering system to allow the slow metering of hydraulic working fluid. Prior to the present invention the only way the rate of metering could be changed was by taking the tool apart and changing the elements of the tool. In the present invention, an adjustable orifice plate in the jarring tool provides a system for regulating the time period of operation at the discretion of the user by controlling flow through a selected hydraulic orifice. This eliminates complete disassembly of the tool to replace elements since the adjustment can be accomplished externally.

DESCRIPTION OF PRIOR ART

In U.S. Pat. No. 2,989,132 to J. L. Downen, patented June 20, 1961, a hydraulic oil well jar is shown. An annular floating seal is disposed in the hydraulic chamber. Liquid passage means allow operating liquid to slowly bypass the piston.

In U.S. Pat. No. 3,004,616 to B. P. Nutter et al patented Oct. 17, 1961, a hydraulic type well jar is shown. A valve member is carried by the mandrel providing first for restricted flow of fluid and then for rapid flow as the jar is extended.

In U.S. Pat. No. 3,349,858 to D. V. Chenoweth, patented Oct. 31, 1967, a hydraulic jarring apparatus having a restricted flow path from its chamber with constant flow regulator means is shown. The displacement of the liquid in the outer or cylindrical portion of the jarring mechanism from one side of the piston to the other occurs at a controlled rate and without the requirement for having close tolerances between the portions of the apparatus. The liquid in the well bore itself can be used in the apparatus.

In U.S. Pat. No. 3,716,109 to W. E. Griffith, patented Feb. 13, 1973, a rotary jar is disclosed for use in well bores when a tool, attached to the jar, becomes so stuck that normal tension on the drill string will not release it. The rotary jar has an outer housing and an inner mandrel with appropriate seals therebetween defining an annular working chamber. A knocker is attached to the mandrel and an anvil is attached to the housing. The working fluid in the working chamber exhibits low viscosity changes with high temperature changes. Within the chamber are located a piston and a valve combination so arranged that when the drill string is under high tension, fluid is forced in minute quantities through the valve combination. This is actually a mutual extension of the mandrel and housing which continues until the piston and valve combination come into contact with an annular sleeve in the chamber. The sleeve moves with the piston and valve combination allowing fluid to dump therebehind, thereby allowing the knocker and anvil to come into jarring contact. Provision is made for resetting the jar so that it may be operated continuously over long periods of time.

In U.S. Pat. No. 3,880,248 to Leonard Mason, patented Aug. 29, 1975, a valve sleeve for use in association with oilfield hydraulic jar tools is shown. The valve sleeve is provided with one or more radial bores at the seat end of the sleeve. The bore connects the bypass passageway between the sleeve and mandrel with the annular metering passageway between the sleeve and the valve fitting section of the barrel. In this manner, high pressure is transmitted from the bypass passageway to the annular passageway to reduce outward belling of the tail end of the valve sleeve. This results in reduced wear of the valve sleeve and improved performance of this portion of the tool.

SUMMARY OF THE INVENTION

The present invention provides a hydraulic jarring tool including means for externally adjusting the sleeve valve flow passage. The jarring tool includes an outer member and an inner member telescopically arranged. Spline means between said outer member and said inner member transmit torque. A hammer and anvil system provides a jarring effect upon actuation of the tool. An upper seal and lower seal provide a fluid seal between said outer member and said inner member. A working fluid is maintained in a working fluid chamber between the upper and lower seals. A detent means provides a tripping action to produce the jarring effect. An orifice plate inside the jarring tool is rotatable to change the fluid path. An exterior port allows a wrench or tool to be inserted to rotate the orifice plate. The above and other objects and advantages of the present invention will become apparent from a consideration of the following detailed description of the invention when taken in conjunction with the accompanying drawings.

DETAILED DESCRIPTION OF THE INVENTION

Figure 1:
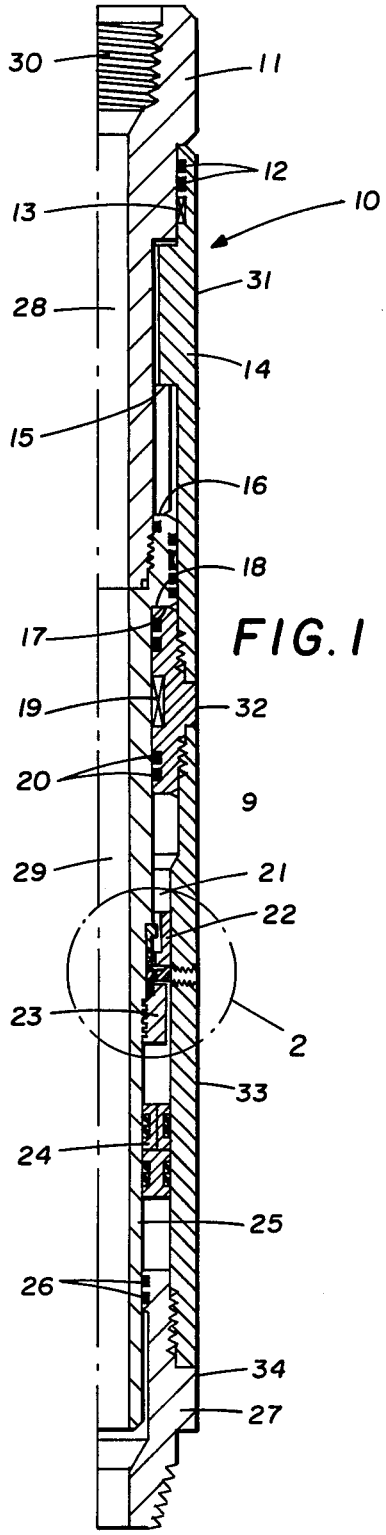
FIG. 1 is a longitudinal view illustrating an embodiment of a jarring tool constructed in accordance with the present invention.

Referring now to the drawings, and in particular to FIG. 1, a hydraulic jarring tool is illustrated therein and generally designated by the reference number 10. Only the right-half of the jarring tool 10 is shown, however, it is to be understood that the jarring tool 10 is substantially symmetrical. The jarring tool 10 is an impact tool adapted to be positioned between the lower section of the drill string (not shown) and the upper section of the drill string (not shown) connected with the drilling equipment at the surface. The jarring tool 10 is the type of tool generally called a hydraulic jar.

The hydraulic jar 10 comprises telescopically arranged inner (upper) mandrel 11 and outer (lower) mandrel 27. The inner mandrel 11 actually comprises two cylindrical, hollow sections, namely the box and spline mandrel section 28 and the piston and wash pipe mandrel section 29. The box connection 30 is provided with an internal thread to be connected to an external thread on the pin end of the drill string component above. The outer mandrel 27 actually comprises four sections, namely the spline mandrel section 31, seal mandrel section 32, piston mandrel section 33 and pin mandrel section 34.

The spline system of the jar 10 comprises a spline system 14 having radially inwardly directed splines on the inside diameter of the outer spline mandrel section 31 engageable with radially outwardly direct splines on the outside diameter of the inner box and spline mandrel section 28. The spline system 14 provides means for transmitting torque and providing telescoping movement of the inner mandrel 11 and outer mandrel 27. A jarring effect is provided by contact between the hammer 16 and anvil 15 when the jar 10 expands and by contact between the hammer 17 and anvil 18 when the jar 10 retracts. The bearings 13 and 19 improve axial movement of mandrels 11 and 27. The wipers 12 and 26 restrict the entry of foreign materials into the working parts of the jar 10.

An annular hydraulic working fluid chamber 21 is provided between inner (upper) mandrel 11 and outer (lower) mandrel 27. The seals 20 provide a fluid seal closing the upper portion of hydraulic chamber 21. The lower portion of the working fluid chamber 21 is sealed by a piston type seal assembly 24. The lower seal assembly 24 comprises a floating compensating annular seal between the outer mandrel 27 and the wash pipe section 25 of the inner mandrel 11. The seal assembly 24 can slide axially along the working chamber area 21 to compensate for volume changes created by the telescopic movement of the mandrels 11 and 27.

An annular sliding sleeve valve detent means is disposed in the hydraulic working chamber 21. The sleeve valve assembly 22 is mounted for limited longitudinal movement in chamber 21 and forms a seal between the cylindrical surfaces of the inner and outer mandrels 11 and 27. An annular lower stop member 23 is located below the sleeve valve assembly 22 in the working chamber 21. The sleeve valve assembly 22 acts as a detent or restraining mechanism providing for the slow metering of the hydraulic working fluid from the upper chamber portion above to the lower chamber portion below when the inner mandrel 11 is pulled upwardly relative to the outer mandrel 27 by tensioning the drill string. The sleeve valve system will be described in greater detail subsequently. A release section 9 of working fluid chamber 21 is located above sleeve valve assembly 22. When the sleeve valve assembly 22 comes adjacent release section 9 of the chamber 21, the wall contact is removed. The working fluid still remaining in compression in chamber 21 will be dumped around the sleeve valve assembly 22 and behind the sleeve valve assembly 22 thereby drastically reducing the resistance of working fluid and permitting upward strain on inner mandrel 11 to bring the hammer 16 and anvil 15 into jarring impact.

Figure 2:
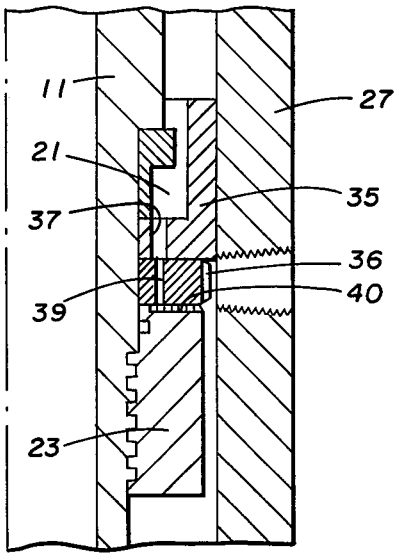
FIG. 2 is an enlarged view of a portion of the jarring tool shown in FIG. 1.

Referring now to FIG. 2, an enlarged view of the sleeve valve assembly 22 is shown. The sleeve valve assembly 22 includes an annular sleeve valve body 35 positioned between the inner mandrel 11 and the outer mandrel 27. The annular lower stop member 23 is located downhole of the sleeve valve 22 in the working chamber 21. The jarring tool utilizes a pull force to pressurize the working fluid above the valve body 35 which is then released to provide an impact blow. During the application of the pull force to the valve body 35, the working fluid is channeled through the orifice 37 in the valve body 35 and through a restrictor orifice in an orifice plate 36. The present invention provides external access to change the size of the restrictor orifice and increase or decrease flow through the sleeve valve assembly 22 thereby regulating the length of time required to obtain the desired pull force. The flow adjustment is accomplished by changing the position of the rotatable orifice plate 36 to increase or decrease flow.

Figure 3:
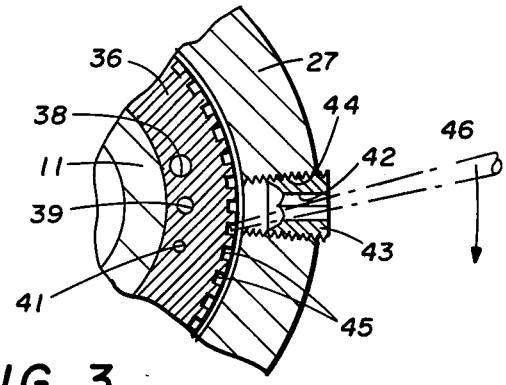
FIG. 3 is a top view of the rotatable orifice plate shown in FIG. 2.

Referring now to FIG. 3, a sectional view of the rotatable orifice plate 36 is shown. The orifice plate 36 has an annular radial surface confronting the annular downhole end of the sleeve valve body 35. The annular radial surface is provided with orifice passages 38, 39 and 41 of different sizes. An indexing tool 46 is projected through a hole 42 in the side of the tool to rotate the orifice plate. Rotation of the orifice plate allows an orifice of a different size to be used as the restrictor orifice. A series of milled grooves 45 are located on the outside surface of orifice plate 36. The indexing tool 46 is extended into one of the grooves and a lever force is used to rotate the orifice plate 36. In order to protect the threads in the hole 44, a plug 43 is threaded into the hole 44. The plug 43 includes the hole 42 for the indexing tool 46. After the orifice plate 36 is rotated to the desired position, the plug 43 is removed and a closure plug is inserted in the hole 44.

The structural details of one embodiment of a jarring tool 10 constructed in accordance with the present invention having been described, the operation of the jarring tool 10 will now be considered with reference to FIGS. 1, 2 and 3. A lower drill string section or borehole tool is attached to the end of lower mandrel 27 at the threaded pin. The box connection on upper mandrel 11 is attached to a drill string. The working fluid fills the working chamber 21. The jarring tool 10 and drill string are lowered into the borehole and the borehole operations continue. If a section of the lower drill string or the borehole tool becomes tightly wedged in the borehole, a jarring action may be applied through the jarring tool 10 to attempt to dislodge the stuck portion. The pull force buildup provided by the restraining or detent system in the jarring tool needs to be adjustable because different forces are required depending upon the borehole conditions. The present invention allows the jarring tool to be easily and quickly adjusted at the drill site and does not require disassembly of the tool.

The adjustable orifice plate 36 on the jarring tool 10 provides a means to regulate the time period of operation at the discretion of the user by controlling flow through a preselected hydraulic orifice. This eliminates complete disassembly of the tool to replace elements because the adjustment can be accomplished externally.

The jarring tool 10 is initially in a fully contracted condition. An axial force is applied to the inner mandrel 11 through the drill string. This puts the working fluid into compression. The only way to relieve the internal pressure in the working fluid is through the sleeve valve assembly 22. A small portion of working fluid will pass through the sleeve valve assembly 22 into that portion of working chamber 21, which is between sleeve valve assembly 22 and the seal assembly 24. The sleeve valve assembly 22 will rise, relatively, in working chamber 21 at an extremely slow speed. When the sleeve valve assembly 22 comes adjacent release section 9 of the chamber 21, the wall contact is removed. The working fluid still remaining in compression in chamber 21 will be dumped around the sleeve valve assembly 22 and thereby drastically reducing the resistance of working fluid and permitting the upward strain to bring the hammer 16 and anvil 15 into a jarring impact. The jarring effect is transmitted through outer mandrel 27 to the stuck portion which might then be dislodged. The adjustable orifice plate 36 provides a means to regulate the time period of operation at the discretion of the user by controlling flow through a preselected restrictor orifice. This eliminates complete disassembly of the tool to adjust flow rate.

The indexing tool 46 is projected through the hole 42 in the side of the tool to rotate the orifice plate 36. Rotation of the orifice plate allows an orifice of a different size to be used as the restrictor orifice. The indexing tool 46 is extended into one of the grooves 45 and a lever force is used to rotate the orifice plate 36. In order to protect the threads in the hole 44, the plug 43 has been threaded into the hole 44. The plug 43 includes the hole 42 for the indexing tool 41. After the orifice plate 36 is rotated to the desired position, the plug 43 is removed and a closure plug is inserted in the hole 44.

To reset the jarring tool 10, it is only necessary to allow the weight of the drill string above to be set down on the jarring tool 10. Working fluid travels into the portion of working chamber 21 located above sleeve valve assembly 22. The sleeve valve body 35 moves upward to the stop 36. This allows the passage 37 to act as a large bypass hole through the sleeve valve body 35 allowing the working fluid to flow rapidly in the opposite direction to recock the jarring tool. Once the contraction is fully complete, the jarring tool 10 is ready to deliver another blow when required.

Figure 4:
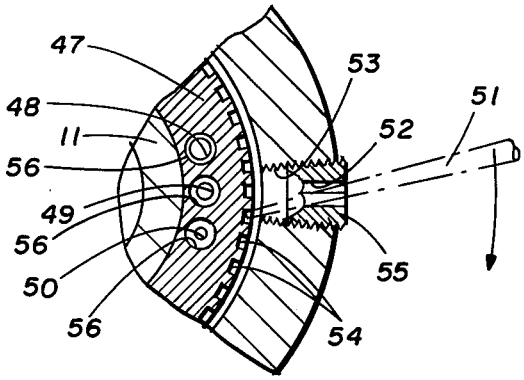
FIG. 4 illustrates another embodiment of the present invention.

Referring now to FIG. 4, the adjustable orifice system of another embodiment of a hydraulic jarring tool is illustrated. A top view of the rotatable orifice plate 47 is shown. The orifice plate 47 has an annular radial surface confronting the annular downhole end of a sleeve valve body. The annular radial surface is provided with orifice passages 48, 49 and 50 of different sizes. An indexing tool 51 is projected through a hole 52 in the side of the tool to rotate the orifice plate 47. Rotation of the orifice plate 47 allows an orifice of a different size to be used as the restrictor orifice. An enlarged bore 56 is located above the orifice passages 48, 49 and 50.

A series of milled grooves 54 are located on the outside surface of orifice plate 47. The indexing tool 51 is extended into one of the grooves and a lever force is used to rotate the orifice plate 47. In order to protect the threads in the access hole 53, a plug 55 is threaded into the access hole 53. The plug 55 includes the hole 52 for the indexing tool 51. After the orifice plate 47 is rotated to the desired position, the plug 55 is removed and a closure plug is inserted in the hole 53.

The structural details of another embodiment of an adjustable orifice system of a jarring tool constructed in accordance with the present invention having been described, the operation of the orifice system will now be considered. The present invention provides external access to change the size of a restrictor orifice and increase or decrease flow through the sleeve valve assembly thereby regulating the length of time required to obtain the desired pull force. The flow adjustment is accomplished by changing the position of the rotatable orifice plate 47 to increase or decrease flow.

The embodiments of the invention in which an exclusive property or privilege is claimed are defined as follows:

1. A hydraulic jar tool connectable to drill string components, comprising:

an outer mandrel having one end attachable to a drill string component;

an inner mandrel extending into said outer mandrel and having an end portion attachable to a drill string component, said outer and inner mandrels having a splined connection permitting non-rotative reciprocating movement of said mandrels;

an anvil and hammer means for producing a jarring action;

means forming a substantially confined annular working fluid chamber between said outer and inner mandrels for reception of a working fluid;

a sleeve in said chamber slidingly mounted between said outer mandrel and said inner mandrel;

said sleeve having a restricted fluid passage extending therethrough;

an adjustable orifice plate that connects with said fluid passage;

a multiplicity of restricted orifice passages in said plate of different sizes to provide an adjustable fluid passage past said sleeve; and means for rotating said orifice plate to provide a fluid passage past said sleeve.

* * * * *